US007911138B2

(12) United States Patent
Kim

(10) Patent No.: US 7,911,138 B2
(45) Date of Patent: Mar. 22, 2011

(54) ENCAPSULATION CAP AND DISPLAY DEVICE INCLUDING THE SAME

(75) Inventor: Min Ku Kim, Jinju-si (KR)

(73) Assignee: LG Display Co., Ltd., Seoul (KR)

( * ) Notice: Subject to any disclaimer, the term of this patent is extended or adjusted under 35 U.S.C. 154(b) by 587 days.

(21) Appl. No.: 11/633,498

(22) Filed: Dec. 5, 2006

(65) Prior Publication Data

US 2007/0228000 A1 Oct. 4, 2007

(30) Foreign Application Priority Data

Apr. 3, 2006 (KR) ..... 10-2006-0030061

(51) Int. Cl.
*H05B 33/04* (2006.01)
*H05B 33/00* (2006.01)

(52) U.S. Cl. ..... 313/512; 313/504; 313/506; 428/917; 428/690

(58) Field of Classification Search ..... 313/512
See application file for complete search history.

(56) References Cited

U.S. PATENT DOCUMENTS

| | | | | |
|---|---|---|---|---|
| 6,878,467 | B2 * | 4/2005 | Chung et al. | 428/690 |
| 2002/0057565 | A1 * | 5/2002 | Seo | 362/84 |
| 2002/0155320 | A1 * | 10/2002 | Park et al. | 428/690 |
| 2006/0076886 | A1 | 4/2006 | Ahn | |

FOREIGN PATENT DOCUMENTS

| | | | |
|---|---|---|---|
| JP | 2000-100562 | A | 4/2000 |
| JP | 2000100562 | A * | 4/2000 |
| JP | 2002-8853 | | 1/2002 |
| KR | 10-2005-0119897 | | 12/2005 |

OTHER PUBLICATIONS

Machine English translation of JP 2002008853 to Wakai et al.*

* cited by examiner

*Primary Examiner* — Sikha Roy
(74) *Attorney, Agent, or Firm* — Morgan, Lewis & Bockius LLP

(57) ABSTRACT

The present invention relates to an encapsulation cap for a display device having a structure which has a reinforced strength and is not modified although a thickness is decreased, and an encapsulation cap according to one embodiment of the present invention may comprises a first plane part; and a second plane part having at least one bead thereon, and disposed in a plane different from a plane of the first plane part, wherein the second plane part is connected with the first plane part.

12 Claims, 7 Drawing Sheets

ENCAPSULATION CAP AND DISPLAY DEVICE INCLUDING THE SAME

CROSS-REFERENCE TO RELATED APPLICATIONS

This application claims priority from Korean Patent Application No. 10-2006-0030061 filed on Apr. 3, 2006, the content of which is incorporated herein by reference in its entirety.

BACKGROUND

1. Field

The present invention relates to an encapsulation cap and a display device including the same. Particularly, the present invention relates to an encapsulation cap having a structure which has a reinforced strength and is not modified although a thickness of a workpiece is decreased and a display device including the same.

2. Background

An organic light-emitting device, one of the display devices, is a device using organic electroluminescence. Organic electroluminescence is a phenomenon that excitons are formed in an (low molecular or high molecular) organic material thin film by re-combining holes injected through an anode with electrons injected through a cathode, and a light of specific wavelength is generated by energy of the formed excitons.

The organic light-emitting device using the above a phenomenon has the basic structure as illustrated in FIG. 1. The organic light-emitting device comprises a glass substrate 200, an indium tin oxide film 102 disposed on the glass substrate 200 and acting as the anode electrode (hereinafter, referred to as "anode electrode"), an insulating layer and an organic light-emitting layer 103 disposed sequentially on the anode electrode and a metal layer 104 disposed on the organic light-emitting layer and acting as the cathode electrode (hereinafter, referred to as "cathode electrode").

FIG. 2 is a plane view of the organic light-emitting device shown in FIG. 1, In FIG. 2, the organic light-emitting device to which a cap is not attached is illustrated. Also, in FIG. 2, an active area 100 consisting of the structural elements described above is shown in the shape of the box.

As shown in FIG. 1 and FIG. 2, in a process of forming the anode electrodes 102 and the cathode electrodes 104, data lines 111 and scan lines 110*a* and 110*b* are formed on a periphery of the active area 100 and connected to the anode electrodes 102 and the cathode electrode 104 in the active area 100, respectively.

In FIG. 1, on the other hand, the reference numeral "108" which is not illustrated indicates a moisture absorbing material layer (hereinafter, referred to as "getter") attached on an inner surface of the cap 106 through an adhesive 107, and the reference numeral "W" indicates a wall formed for separating the cathode electrodes 104.

Here, a cap 106 is attached on a cap-attaching region 112 of the substrate 200 defined as an outer region of the active area 100 through an adhesive 106A (hereinafter, referred to as "sealant"). The cap 106 is used for isolating and protecting the structural elements in the active area 100 from an external environment such as moisture, light and the like and is mainly made from metal material.

An entire thickness (height) of the organic light-emitting device having the structure as described above includes a thickness of the substrate 200, a thickness of the sealant 106A applied on the substrate 200, a thickness of the cap 106 and a thickness of a reflective film (not shown) attached on a lower surface of the substrate 200 which is opposed to a surface on which the structural elements are disposed.

For example, thicknesses of the members constituting the organic light-emitting device with a thickness of 1.83 mm are as follows:

Glass substrate (200): 0.7 mm
Sealant (106A): 0.03 mm
Reflective film: 0.2 mm
Cap (106): 0.9 mm
(not a thickness of the workpiece, but an entire thickness of the cap)

In order to slim down the organic light-emitting device, the study has been conducted for reducing a thickness of each structural member, however, there are limitations to reduce a thickness of the sealant 106A applied on the substrate for attaching the cap and a thickness of the reflective film due to the characteristics of the material thereof.

Accordingly, an entire thickness of the organic light-emitting device can be reduced by reducing thicknesses of the substrate 200 and the cap 106. In particular, it is more effective to reduce a thickness of the cap 106 which has more room than the glass substrate 200 in terms of the dimension and the strength.

FIG. 3 is a sectional view of the cap according to the related art. For example, a cap 106-1 with an entire thickness T1 of 0.9 mm is made from a metal workpiece having a thickness t1 of 0.3 mm. A space S1 having a height of approximately 0.6 mm is formed in the cap 106-1 due to a difference between a central portion C-1 and an attaching portion B-1 to be attached to an attaching region (112 in FIG. 2) of the substrate.

If the cap 106-1 shown in FIG. 3 is made from the metal workpiece having a thickness which is thin by approximately 0.1 mm, that is, having a thickness of 0.2 mm, an entire height T1 of the cap 106-1 can be reduced by approximately 0.2 mm while the same height of the inner space S1 is maintained.

On the other hand, there is a solution that a height of the inner space S1 is reduced to reduce an entire height T1 of the cap 106-1. However, there is a limit to reduce a height of the inner space S1 of the cap 106-1 if the special regard will be paid to the fact that a distance between the getter 108 (in FIG. 1) attached to an inner surface of the central portion C1 of the cap 106-1 and the structural element such as the wall W (in FIG. 1) or the cathode electrode 104 should be maintained to some degree.

FIG. 4 is a sectional view of the cap having another structure, according to the related art. The cap 106-2 shown in FIG. 4 has a first space S2 formed on a central portion C-2 and a second space S2-1 formed on a central portion of the first space S2. The getter 108 (in FIG. 1) is attached to the central portion C-2 corresponding to the second space S2-1. Due to the second space S2-1, the cap 106-2 has a structure in which some region of the central portion C-2 is protruded with a certain height.

If the cap 106-2 having the structure as described above is made from the metal workpiece having a thickness which is thin by approximately 0.1 mm, that is, having a thickness of 0.2 mm, an entire height T2 of the cap 106-2 can be reduced by approximately 0.2 mm while the same height of the inner space S1 and S2 is maintained.

As described above, in order to reduce a thickness of the organic light-emitting area, that is, an entire thickness of the cap 106-1 or 106-2, it is most preferred to reduce a thickness of the workpiece (for example, the metal sheet) used for manufacturing the cap.

However, if the cap 106-1 or 106-2 is made from the metal sheet having a reduced thickness, it is difficult to obtain a desired shape and a specification of the cap. That is, a deformation such as a deflection is generated on a large portion (that is, C-1 in FIG. 3 and C-2 in FIG. 4 to which the getter is attached) of the cap with a thin thickness. Accordingly, there is a strong possibility that the getter is contacted with the structural elements of the device. Such contact between the getter and the structural element increases the possibility that a line fail of the cathode electrodes is generated, consequently an inferiority of the organic light-emitting device is caused by the above contact In particular, the metal cap 106-1 or 106-2 made from the thin metal sheet has a weak structural strength, and a distortion caused by a spring back phenomenon (an elastic back caused by removing a load after the plastic deformation and an elastic deformation generated after bending) is also generated on the cap, and so a function of the cap can undergo the serious influence.

BRIEF DESCRIPTION OF THE DRAWINGS

The embodiments will be described in detail with reference to the following drawings in which like reference numerals refer to like elements.

DETAILED DESCRIPTION OF THE INVENTION

An object of a present invention is to provide an encapsulation cap which can be solve the above mentioned problems caused by a thin workpiece and has the structure being capable of preventing a deformation caused by a workpiece with a thin thickness for miniaturizing the display device, and a display device comprising the same.

Hereinafter, the encapsulation cap and the display device comprising the same according to the embodiments of the present invention will be explained in more detail with reference to the accompanying drawings. On the other hand, the organic light-emitting devices will be explained for explanation purposes, however, the present invention is not limited to the organic light-emitting devices.

First Embodiment

Figure 5:
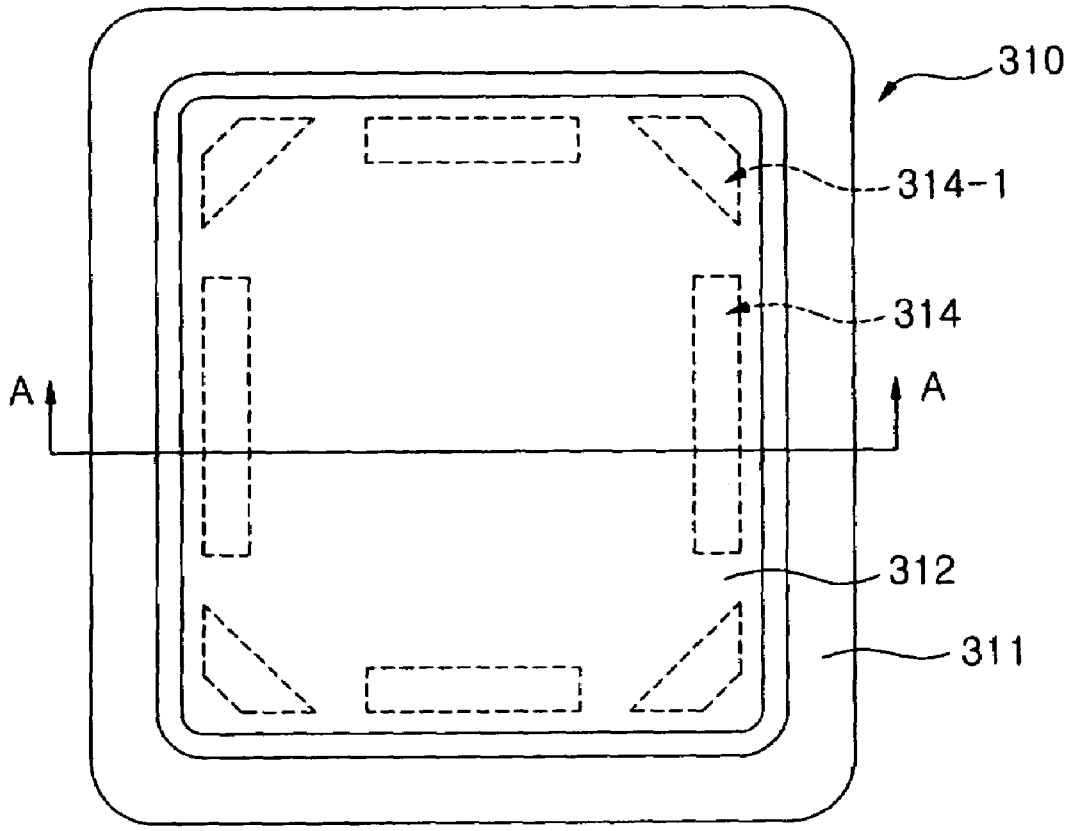
FIG. 5 is a plane view of a cap according to the first embodiment of the present invention.
Figure 6:
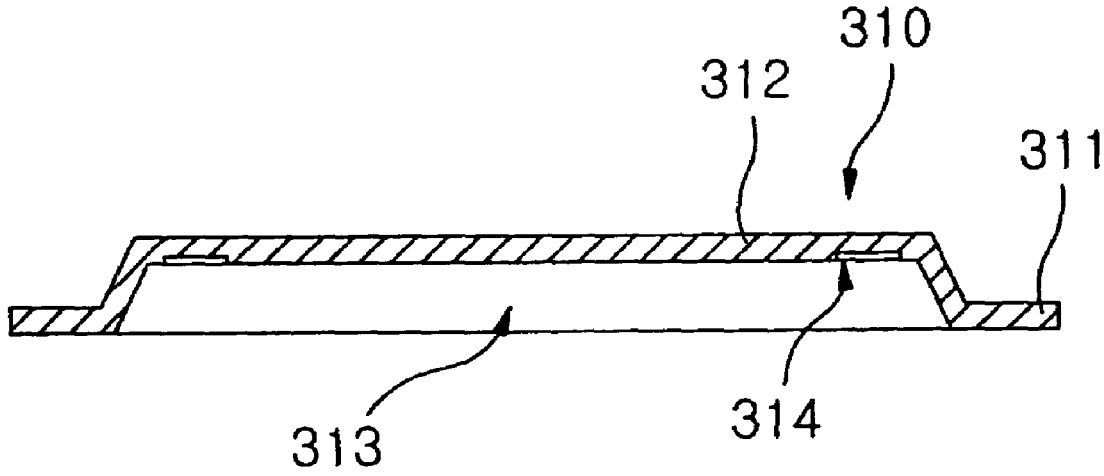
FIG. 6 is a sectional view taken along the line A-A in FIG. 5.

FIG. 5 is a plane view of a cap according to the first embodiment of the present invention and FIG. 6 is a sectional view taken along the line A-A in FIG. 5. In FIG. 5 which is a plane view, beads which will be described below are indicated by the dotted line. Here, the term of "bead" used in this description and the claim means a groove with a certain length and depth formed on a workpiece.

The cap 310 according to this embodiment is manufactured through a machining process for a metal sheet with a certain thickness (for example, 0.2 mm). The cap 310 comprises an attaching part 311 hereinafter, referred to "first plane part") to be attached to a cap attaching region of a substrate (not shown) by an adhesive (sealant) and a central part 312 hereinafter, referred to as "second plane part") on which a moisture absorbing material layer (hereinafter, referred to as "getter") is attached. Structural elements disposed on the substrate are received in a space part 313 formed due to a height difference between the first plane part 311 and the second plane part 312.

The most important feature of the cap 310 according to this embodiment of the present invention is that at least one bead 314 and 314-1 are formed on an inner surface of the second plane part 312 for reinforcing a strength of the cap and preventing the cap from being deformed. A configuration, an arrangement and a function of the beads are more concretely illustrated below.

On a region of the cap 310 except the first plane part 311, that is, on a periphery of an inner surface of the second plane part 312, a plurality of beads 314 having a certain depth are formed along each side of the first plane part 311. In particular, oblique beads 314-1 making a certain angle with the adjacent beads 314 are formed on each corner sections of the second plane part 312.

A size (length, width and depth) of the beads 314 and 314-1 are not limited, and the beads 314 and 314-1 can be formed on any place except the region on which the getter is attached later.

Second Embodiment

Figure 7:
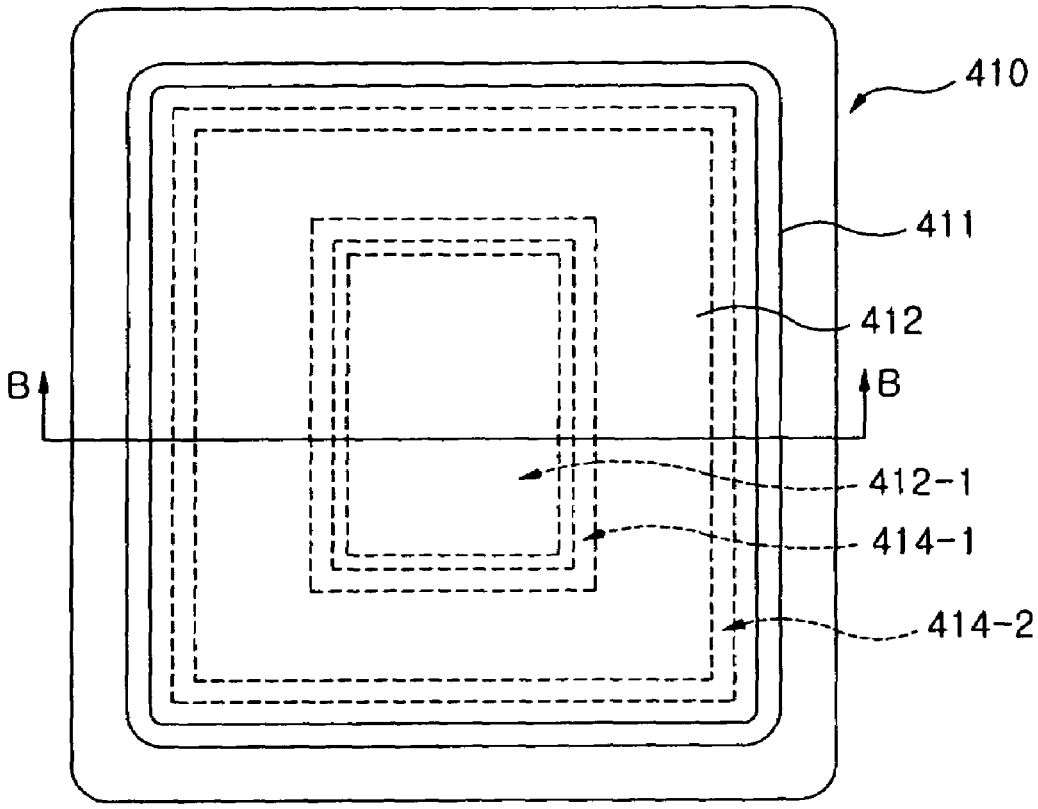
FIG. 7 is a plane view of a cap according to the second embodiment of the present invention.
Figure 8:
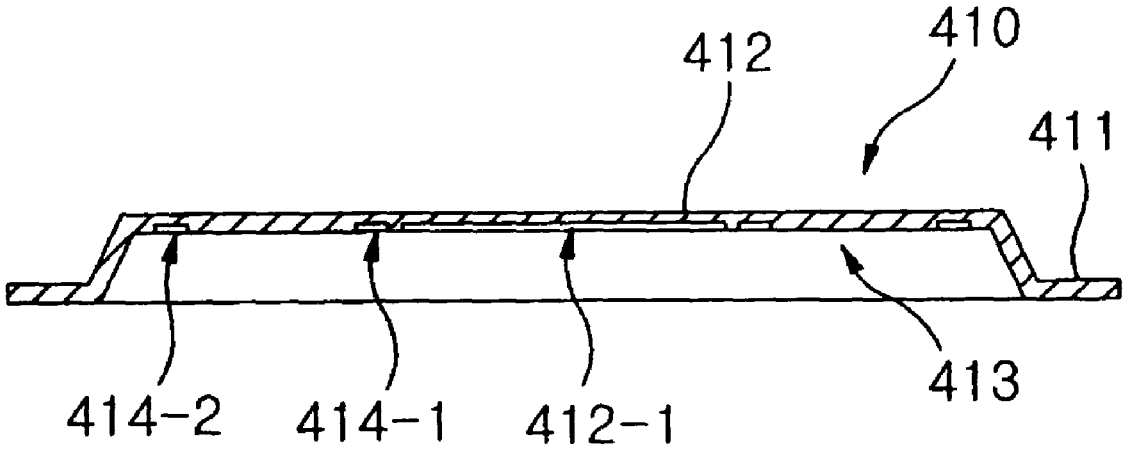
FIG. 8 is a sectional view taken along the line B-B in FIG. 7.

FIG. 7 is a plane view of a cap according to the second embodiment of the present invention and FIG. 8 is a sectional view taken along the line B-B in FIG. 7. In FIG. 7 which is a plane view, beads which will be described below are illustrated by the dotted lines.

The cap 410 according to this embodiment has a structure which differs from that of the cap 310 shown in FIG. 5. That is, the cap 410 comprises a first plane part 411 to be attached to a cap attaching region of a substrate (not shown) and a second plane part 412. A receiving part 412-1 is formed on an inner surface of the second plane part 412. The receiving part 412-1 is a recess having a certain depth and a moisture absorbing material layer hereinafter, referred to as "getter") is attached to the receiving part 412-1. Although the getter receiving part 412-1 is formed on an inner surface of the second plane part 412, the second plane part 412 has an outer flat surface.

On the other hand, structural elements disposed on the substrate are received in a space part 413 formed due to a height difference between the first plane part 411 and the second plane part 412.

In addition t the getter receiving part 412-1, the most important feature of the cap 410 according to this embodiment of the present invention is that at least one bead 414-1 and 414-2 are formed on an inner surface of the second plane part 412 for reinforcing a strength of the cap and preventing the cap from being deformed. A configuration, an arrangement and a function of the beads are more concretely illustrated below.

On a region of the cap 410 except the first plane part 411, that is, on an outside of the getter receiving part 412-1 of the second plane part 412, the first bead 414-1 is formed, and a second bead 414-2 is formed on a periphery of an inner surface of the second plane part 412.

The first bead 414-1 is formed along the getter receiving part 412-1 such that the first bead forms a closed-loop shape and the second bead 414-2 is formed along the first bead 414-1 such that the second bead also forms a closed-loop shape. The first bead 414-1 and the second bead 414-2 have a certain width and depth and are spaced apart from each other.

Third Embodiment

Figure 9:
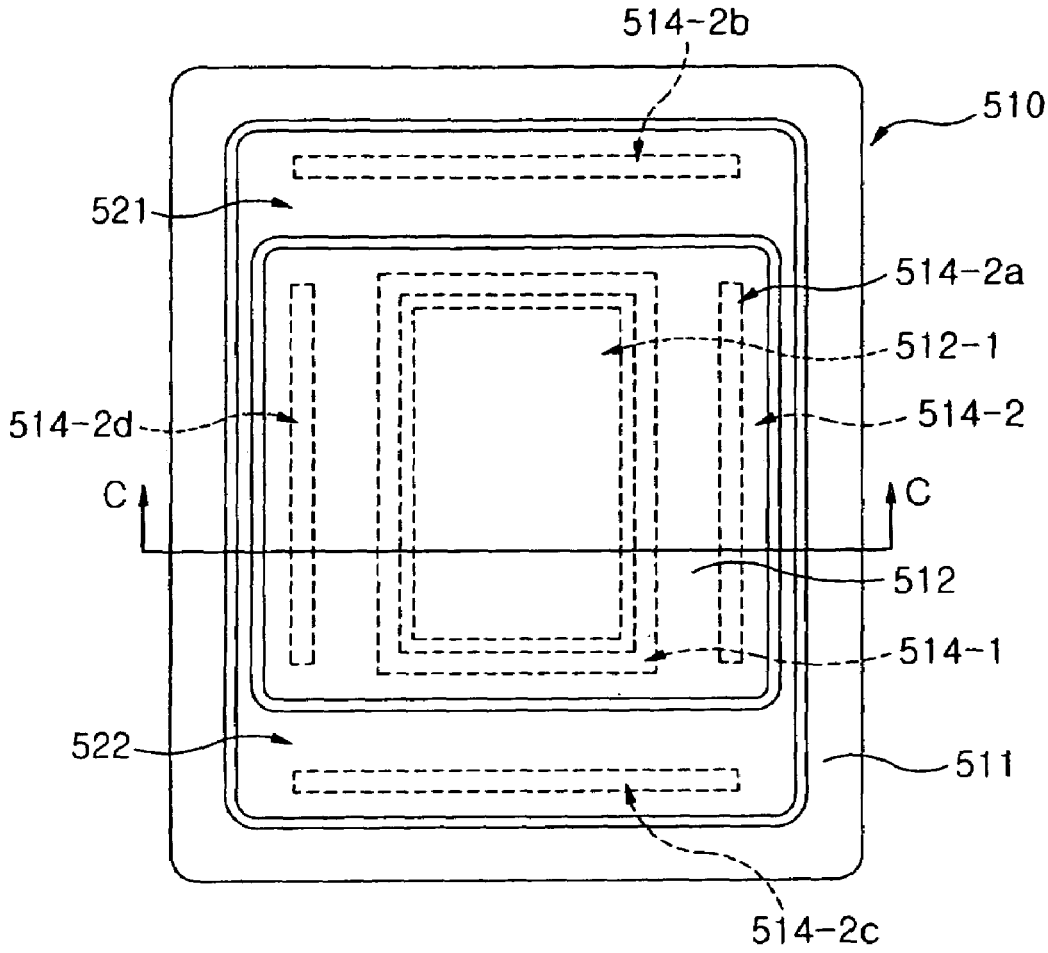
FIG. 9 is a plane view of a cap according to the third embodiment of the present invention.
Figure 10:
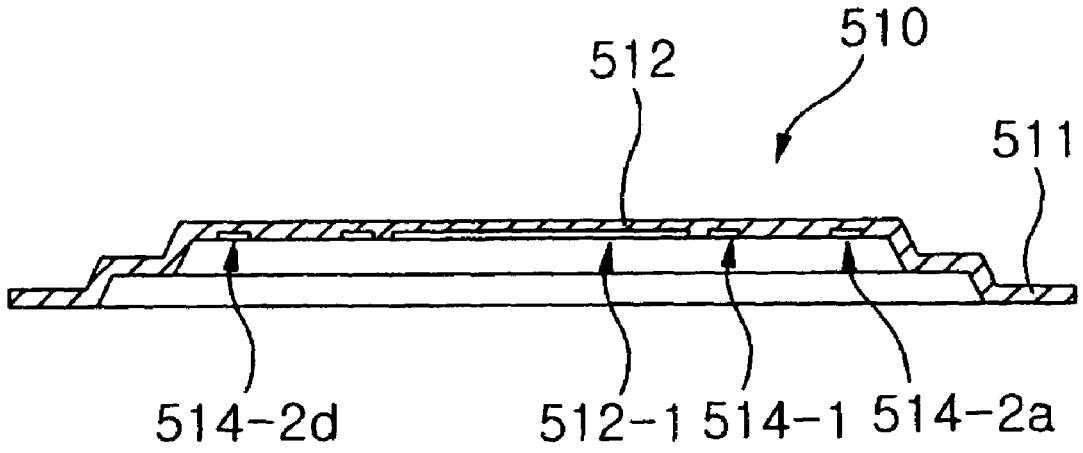
FIG. 10 is a sectional view taken along the line C-C in FIG. 9.

FIG. 9 is a plane view of a cap according to the third embodiment of the present invention and FIG. 10 is a sectional view taken along the line C-C in FIG. 9. In FIG. 9 which is a plane view, beads which will be described below are illustrated by the dotted lines.

The cap 510 according to this embodiment has a structure which differs from that of the cap 410 shown in FIG. 7.

That is, the cap 510 comprises a first plane part 511 to be attached to a cap attaching region of a substrate (not shown) and a second plane part 512. A receiving part 512-1 is formed on an inner surface of the second plane part 512. The receiving part 512-1 is a recess having a certain depth and a moisture absorbing material layer (hereinafter, referred to as "getter") is attached to the receiving part 512-1. On the other hand, structural elements disposed on the substrate are received in a space part 513 formed due to a height difference between the first plane part 511 and the second plane part 512.

In addition to the getter receiving part 512-1 having a certain depth, the most important feature of the cap 510 according to this embodiment of the present invention is that at least one bead 514-1 and 514-2 are formed on an inner surface of the second plane part 512 for reinforcing a strength of the cap and preventing the cap from being deformed. A configuration, an arrangement and a function of the beads are more concretely illustrated below.

On a region of the cap 510 except the first plane part 511, that is, on an outside of the getter receiving part 512-1 of the second plane part 512, the first bead 514-1 is formed, and the second bead 514-2 is formed on a periphery of the second plane part 512 (that is, an outside of the first bead 514-1).

The first bead 514-1 is formed along the getter receiving part 512-1 such that the first bead forms a closed-loop shape and the second bead 514-2 is formed along the first bead 514-1. The second bead 514-2 is divided into a plurality of unit beads 514-2*a*, 514-2*b*, 514-2*c* and 514-2*d*.

On the other hand, the cap 510 according to this embodiment further comprises a third plane part disposed between the first plane part 511 and the second plane part 512. At least two third plane parts 521 and 522 are formed and disposed on the same plane. The unit beads 514-2*b* and 514-2*d* are formed on surfaces of the third plane parts 521 and 522, respectively.

As shown in FIG. 10, due to the third plane parts 521, 522 disposed at both sides of the second plane part 512, an entire surface of the cap 510 has a two-steps structure, and so a distortion of the cap 510 can be sufficiently prevented.

On the other hand, a process of attaching the cap to the substrate, a pusher is employed for making move upward the cap toward the substrate and pressurizing the cap. In order carry out the above function, a block of the pusher is contacted with a surface (plane surface) of the cap, and so a pressure exerted on the cap through the block of the pusher functions as one of the major causes by which a deformation of the cap is generated.

Accordingly, it is preferred that a contact area between the block of the pusher and the cap is minimized. In the cap 510 according to this embodiment, there is a height difference between the second plane part 512 and each of the third plane part 521, 522 disposed at both sides, and so it is difficult to utilize the block of the conventional pusher. That is, the block of the conventional pusher has a rectangular frame shape corresponding to and contacted with a surface of the cap, however, the block of the pusher should consist of two bars which correspond to the both third plane parts 521, 522 and are in parallel to each other so as to pressurize the cap 510 according to this embodiment.

Accordingly, in a state where two bars constituting the block of the pusher are contacted with both third plane parts 521, 522, the cap 510 is moved upward and pressurized by the block of the pusher. And so, a contact area between the block of the pusher and the cap 510, particularly, the second plane part 512 with relatively large surface can be remarkably reduced. Consequently, a deformation of the cap 510 caused by the pusher can be minimized.

Fourth Embodiment

Figure 11:
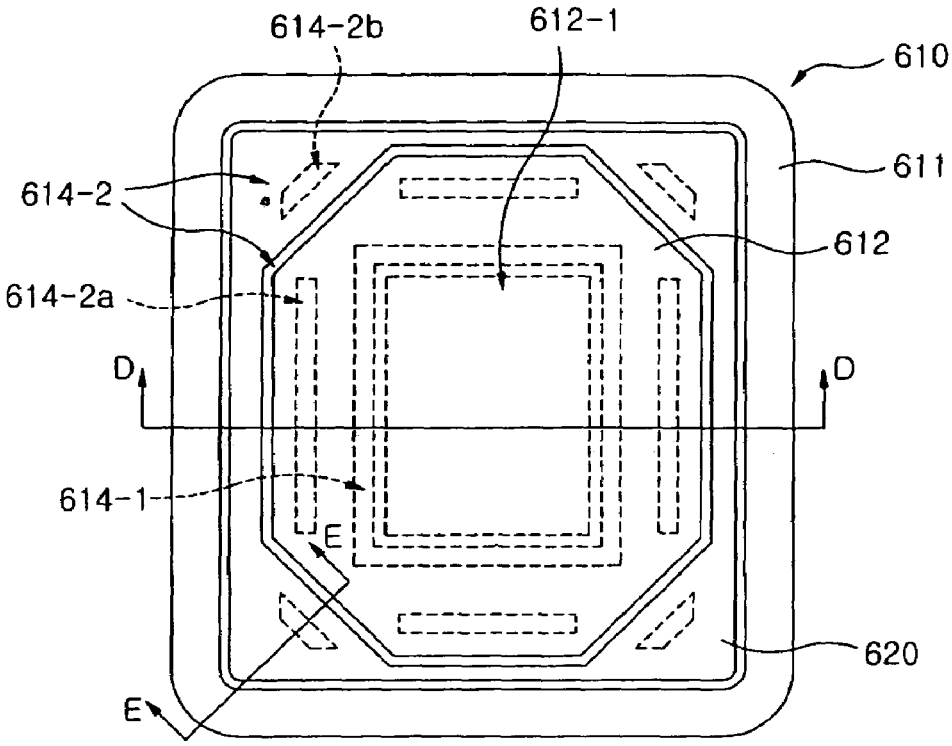
FIG. 11 is a plane view of a cap according to the fourth embodiment of the present invention.
Figure 12:
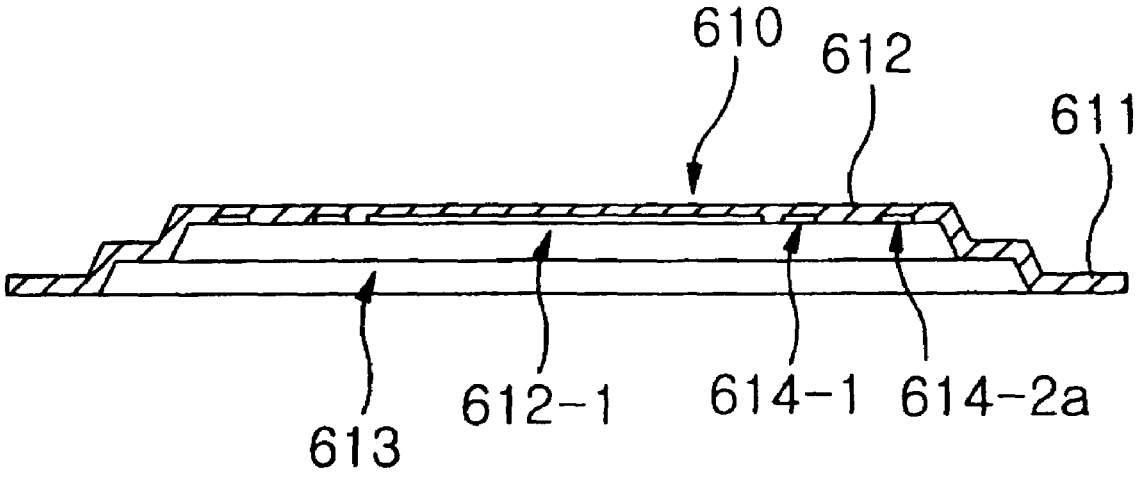
FIG. 12 is a sectional view taken along the line D-D in FIG. 11.

FIG. 11 is a plane view of a cap according to the fourth embodiment of the present invention, and FIG. 12 is a sectional view taken along the line D-D in FIG. 11. In FIG. 11 which is a plane view, beads which will be described below are illustrated by the dotted lines.

The cap 610 according to the fourth embodiment comprises a first plane part 611 to be attached to a cap attaching region of a substrate (not shown) and a second plane part 612. A receiving part 612-1 is formed on an inner surface of the second plane part 612. The receiving part 612-1 is a recess having a certain depth and a moisture absorbing material layer (hereinafter, referred to as "getter") is attached to the receiving part 612-1. On the other hand, structural elements disposed on the substrate are received in a space part 613 formed due to a height difference between the first plane part 611 and the second plane part 612.

In addition to the getter receiving part 612-1 having a certain depth, the most important feature of the cap 610 according to this embodiment of the present invention is that at least one bead 614-1 and 614-2 are formed on an inner surface of the second plane part 612 for reinforcing a strength of the cap and preventing the cap from being deformed. A configuration, an arrangement and a function of the beads are more concretely illustrated below.

On a region of the cap 610 except the first plane part 611, that is, on an outside of the getter receiving part 612-1 of the second plane part 612, the first bead 614-1 is formed, and the second bead 614-2 is formed on a periphery of the second plane part 612 (that is, an outside of the first bead 614-1).

The first bead 614-1 is formed along the getter receiving part 612-1 such that the first bead forms a closed-loop shape, and the second bead 614-2 is formed along the first bead 614-1. The second bead 614-2 is divided into a plurality of unit beads 614-2*a* and 614-2*b*.

Figure 13:
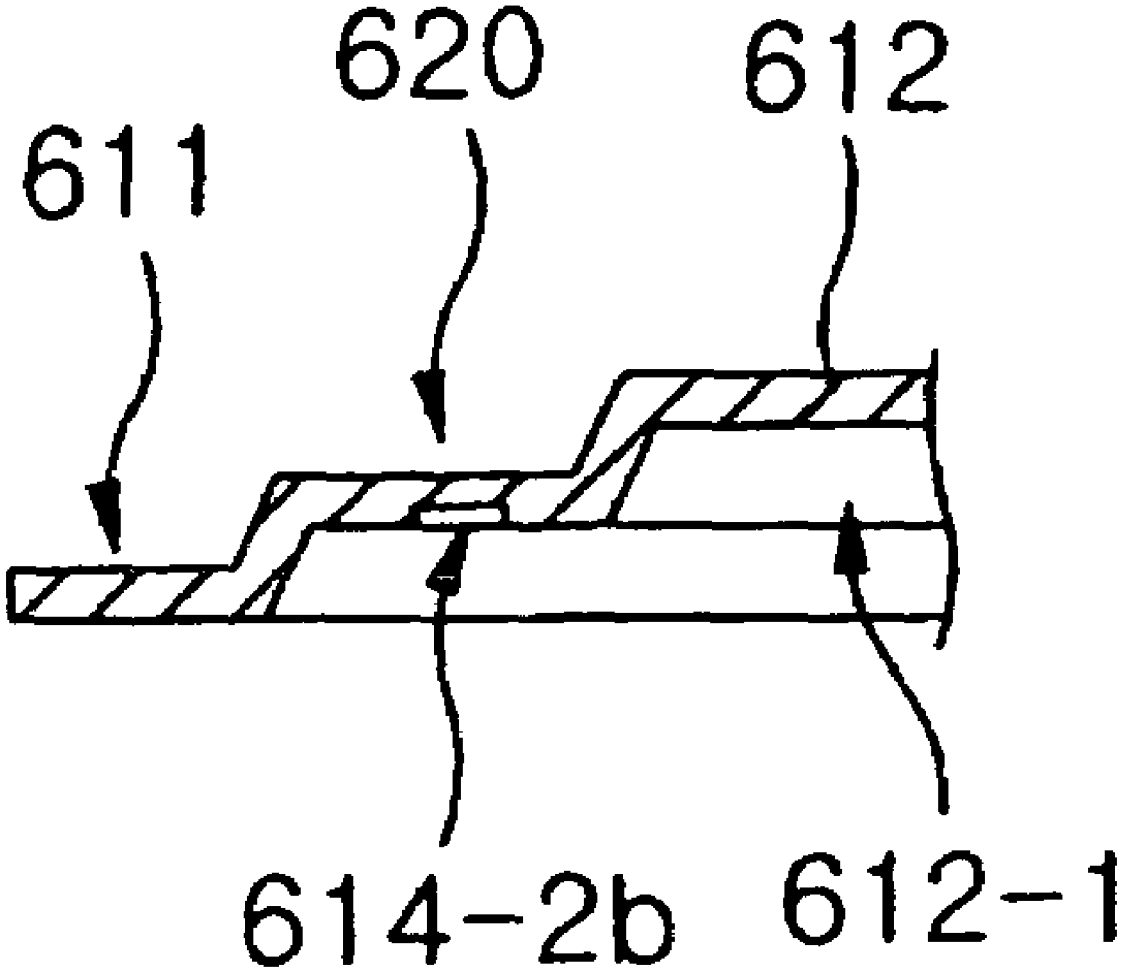
FIG. 13 is a partial sectional view taken along the line E-E in FIG. 11.

As known from FIG. 11 and FIG. 13 which is a sectional view taken along the line E-E in FIG. 11, on the other hand, the cap 610 according to this embodiment further comprises third plane parts 620 formed corners thereof. Each of the third plane parts 620 is disposed between a corner of the first plane part 611 and a corner of the second plane part 612, and the third plane part 620 differs from the second plane part 612 in a height. Also, the third plane parts 620 are disposed on a same plane.

The unit bead 614-2*b* is formed on a surface of each third plane part 620. Accordingly, the second bead 614-2 consists of a plurality of unit beads 614-2*a* (four unit beads in FIG. 11) corresponding to the sides of the first bead 614-1 and a plurality of unit beads 614-2*b* (four unit beads in FIG. 11) formed on the third plane parts 620. At this time, the unit beads 614-2*a* and 614-2*b* are spaced apart from the first bead 614-1 with a predetermined distance.

Each of the third plane parts 620 has a triangular shape, and each unit bead 614-2*b* formed on each third plane part 620 is aligned with the unit beads 614-2*a* adjacent thereto at a predetermined angle. On the other hand, due to the third plane parts 620 disposed at the corners of the second plane part 612, an entire surface of the cap 610 has a two-steps structure, and so a distortion of the cap 610 can be sufficiently prevented.

Figure 1:
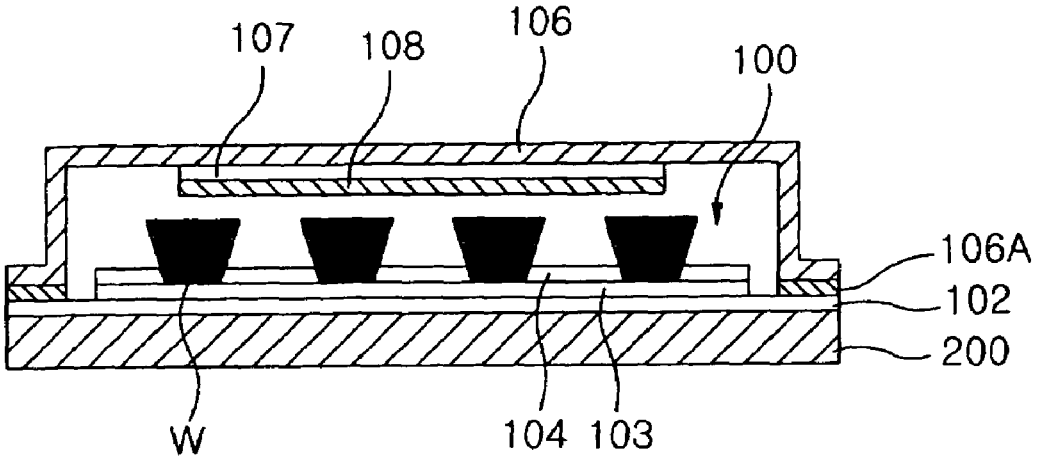
Fig. 1 (Related Art)
FIG. 1 is a sectional view showing schematically a structure of an organic light-emitting device of the related art.
Figure 2:
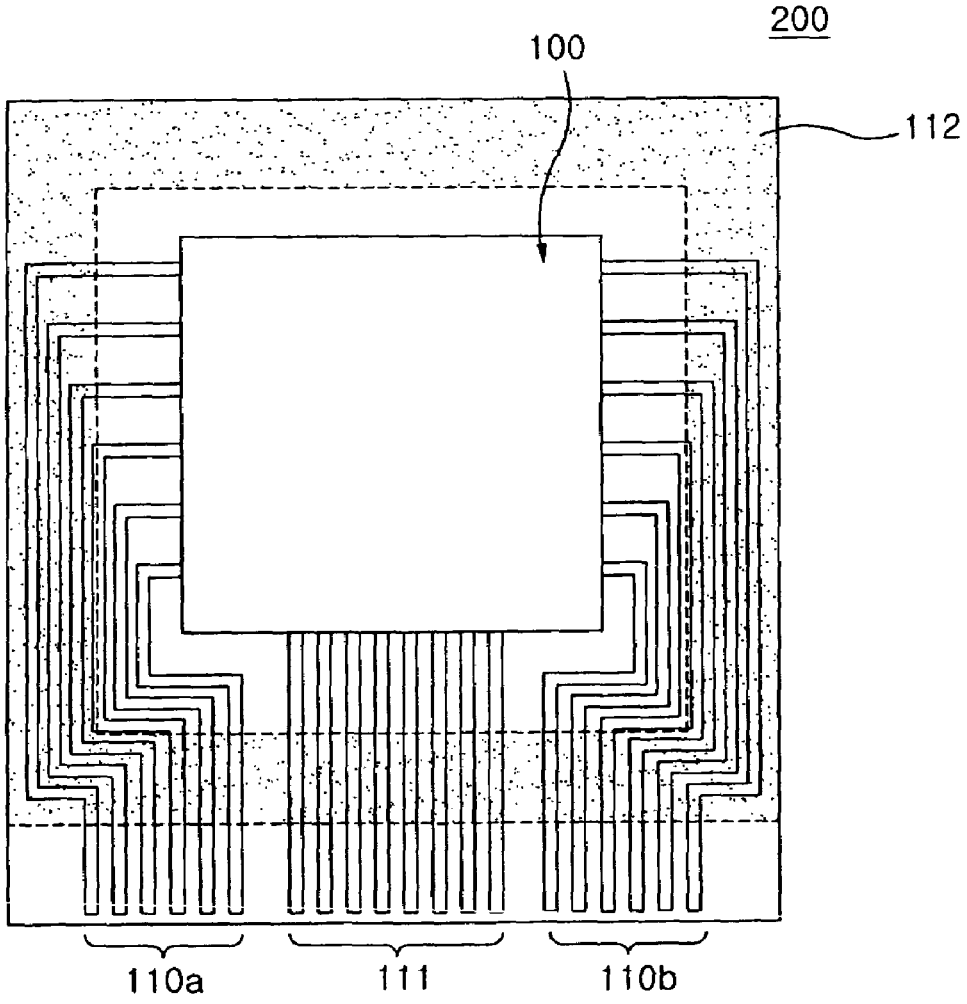
Fig. 2 (Related Art)
FIG. 2 is a plane view of the organic light-emitting device to which a cap is not attached, shown in FIG. 1.
Figure 3:
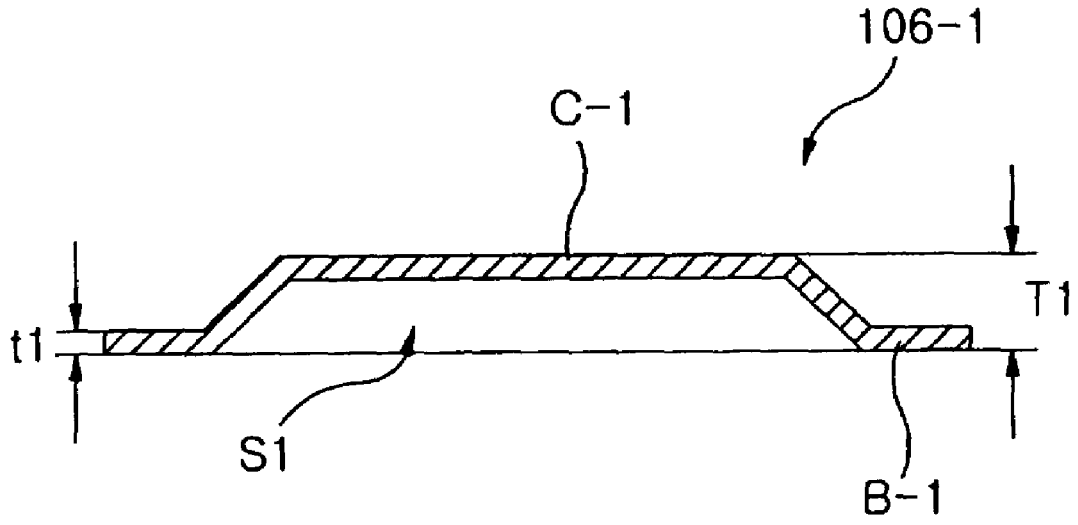
Fig. 3 (Related Art)
FIG. 3 and FIG. 4 are detailed sectional views of a cap shown in FIG. 1.
Figure 4:
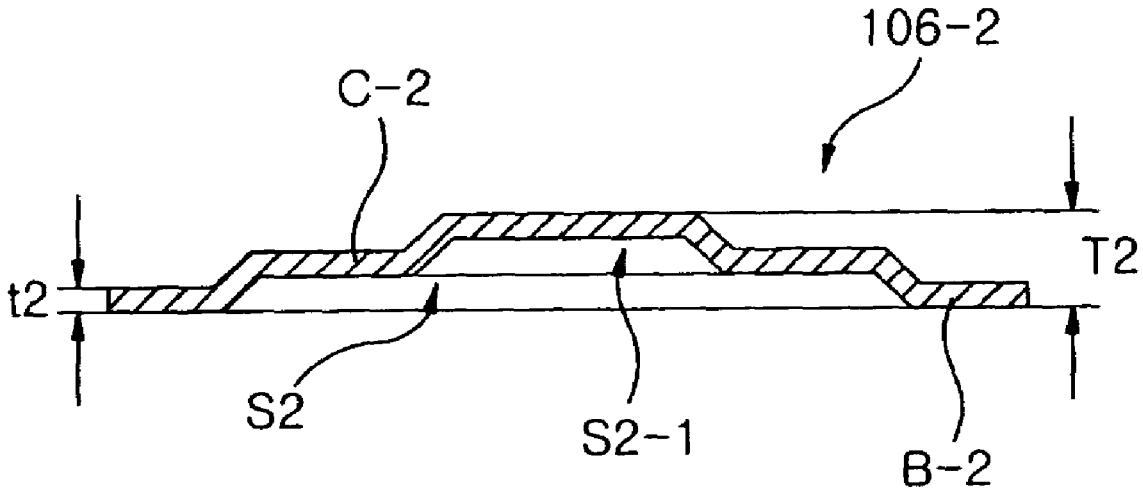
Fig. 4 (Related Art)

As compared with the caps 106-1 and 106-2 shown in FIG. 3 and FIG. 4, the caps 310, 410, 510 and 610 according to the embodiments of the present invention can have the advantages as follows.

First of all, in a case where the cap is made from a workpiece having a significant thin thickness (for example, 0.2 mm), the cap can secure the sufficient structural strength due to a plurality of beads. Also, a torsion of the cap and a deflection of the second plane part with a relatively area which can be caused by the thin workpiece are prevented, and so a surface planarization of the cap can be maintained.

Although the cap is made of the workpiece with a thin thickness, the present invention can reinforce the structural strength of the cap and can prevent a deformation of the cap from being generated, and so an entire thickness of the cap is remarkably reduced and a shape of the cap can be stably maintained.

In particular, as shown in FIG. 11, the third plane parts 620 having a triangular shape are disposed on the corners of the second plane part 612 and the bead 614-2*b* formed on the third plane part 620 is aligned with the adjacent beads, and so the torsion of the entire cap can be completely inhibited.

As shown in FIG. 7, FIG. 9 and FIG. 11, on the other hand, the getter receiving part 412-1 (and 512-1, 612-1) is formed on the second plane part of the cap 410 (and 510, 610) and the getter is attached on a surface of the getter receiving part 412-1 (and 512-1, 612-1). Due to this structure, accordingly, although a height of the space formed by a height difference between the first plane part and the second plane part is reduced, the getter received in the getter receiving part 412-1 (and 512-1, 612-1) does not contact with the structural elements of the device, and so a line fail of the electrode is nor occurred.

Here, the bead and the getter receiving part (that is, recess) having a certain depth can be formed by the mechanical machining as well as the chemical machining such as an etching.

An embodiment of the present invent on may be achieved in a whole or in part by a cap comprising a first plane part; and a second plane part having at least one bead thereon, and disposed in a plane different from a plane of the first plane part, wherein the second plane part is connected with the first plane part.

Another embodiment of the present invention be achieved in a whole or in part by a display device comprising a substrate; an active area disposed on the substrate; and a cap comprising a first plane part attached to the substrate, and a second plane part having at least one bead thereon and disposed to correspond to the active area in a plane different from a plane of the first plane part.

Any reference in this specification to "an embodiment," "another embodiment," "the first embodiment," "the second embodiment," "the third embodiment," or "the fourth embodiment" means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications 1 in the component parts and/or arrangements, alternative uses will also be apparent to those skilled in the art.

What is claimed is:

1. A cap comprising:

a first plane part configured to be attached on a substrate; and a second plane part having a getter region configured to receive a moisture absorbing material and a plurality of beads configured to reinforce a strength of the second plane, and disposed in a plane different from a plane of the first plane part, wherein the plurality of beads are formed in different sizes and disposed, apart from one another, along an outer region of the second plane part except the getter region, and wherein the second plane part is connected with the first plane part.

2. The cap according to claim 1, wherein at least one bead is at least one recess disposed in an outer region of the second plane part.

3. The cap according to claim 1, wherein the getter region has a recess thereon, and wherein the plurality of the beads comprise:

a first bead disposed along the outer portion of the recess to have a loop shape; and a second bead disposed on an outer region of the second plane part.

4. The cap according to claim 3, wherein the first bead and the second bead are closed-loop type recess which are spaced apart from each other.

5. The cap according to claim 3, wherein a plurality of the second beads are spaced apart from the first bead with a predetermined distance.

6. The cap according to claim 3, further comprising a third plane part disposed between the first plane part and the second plane part, and connected with the first plane part and the second plane part.

7. The cap according to claim 6, wherein a plurality of the third plane parts are disposed between corners of the first plane part and corners of the second plane part.

8. The cap according to claim 7 wherein a plurality of the second beads are spaced apart from the first bead with a predetermined distance.

9. The cap according to claim 7, wherein the third plane part has at least one bead thereon.

10. The cap according to claim 7, wherein the third plane parts are disposed on a same plane.

11. A display device comprising:

a substrate;

an active area disposed on the substrate; and a cap comprising a first plane part attached to the substrate, and a second plane part having a getter region configured to receive a moisture absorbing material and a plurality of beads configured to reinforce a strength of the second plane and disposed to correspond to the active area in a plane different from a plane of the first plane part, wherein the plurality of beads are formed in different sizes and disposed, apart from one another, along an outer region of the second plane part except the getter region.

12. The display device according to claim 11, wherein the active area comprises:

an anode electrode disposed on the substrate;

an organic light-emitting layer disposed on the anode electrode; and a cathode electrode disposed on the organic light-emitting layer.

* * * * *